United States Patent [19]

Easter

[11] Patent Number: 5,029,741

[45] Date of Patent: Jul. 9, 1991

[54] FIREARM HOLDING APPARATUS

[76] Inventor: Michael D. Easter, 840 J St., Penrose, Colo. 81240

[21] Appl. No.: 482,696

[22] Filed: Feb. 21, 1990

[51] Int. Cl.[5] ..... F41C 33/00

[52] U.S. Cl. ..... 224/149; 224/913; 224/250

[58] Field of Search ..... 224/149, 150, 192, 193, 224/231, 242, 250, 911, 913, 912

[56] References Cited

U.S. PATENT DOCUMENTS

| | | | |
|---|---|---|---|
| 2,001,321 | 5/1935 | Berns | 224/193 |
| 2,520,285 | 8/1950 | Olson | 224/149 |
| 2,588,467 | 3/1952 | Barney | 224/149 |
| 2,982,455 | 5/1961 | Rosen | 224/155 |
| 3,081,923 | 3/1963 | Bagby | 224/149 |
| 3,422,497 | 1/1969 | Lyons | 224/149 |
| 4,544,089 | 10/1985 | Tabler | 224/911 |
| 4,787,540 | 11/1988 | Barry | 224/193 |
| 4,911,345 | 3/1990 | James et al. | 224/149 |

FOREIGN PATENT DOCUMENTS

| | | | |
|---|---|---|---|
| 2227510 | 11/1974 | France | 224/149 |
| 6960 | of 1900 | United Kingdom | 224/913 |

*Primary Examiner*—Ernest G. Cusick
*Assistant Examiner*—Glenn T. Barrett
*Attorney, Agent, or Firm*—Klaas & Law

[57] ABSTRACT

A firearm holder of improved efficiency and design. The apparatus includes first and second movable gun support members. Each gun support member includes a lower end and an upper end. The upper ends of both members are spaced from each other to define a gun receiving zone therebetween. Positioned within the gun receiving zone and suspended between the first and second support members is a medial support member. Also included in an adjusting strap made of non-abrasive material designed to vary the distance between the first and second support members. In a preferred embodiment, the strap has a length sufficient to completely cover the first, second, and medial support members. In addition, the strap includes a free end which is slidably adjustable.

20 Claims, 4 Drawing Sheets

FIREARM HOLDING APPARATUS

BACKGROUND OF THE INVENTION

The present invention generally relates to firearm accessories, and more particularly to a firearm holder of improved efficiency and design.

Recreational and professional firearm users frequently experience fatigue after carrying their weapons for extended periods of time. For example, a high level of fatigue is encountered by hunters who often remain in a fixed position holding their weapons for long time intervals. This fatigue translates into back, shoulder, and neck pain. In addition, the level of fatigue is substantially increased when large and heavy guns (e.g. high powered rifles) are used. To eliminate this problem, the gun user must either put down his weapon at frequent intervals or attempt to endure the fatigue. Neither of these alternatives are acceptable for most gun users.

Accordingly, a need exists for an apparatus designed to relieve firearm users of fatigue and strain as described above. The present invention satisfies this need in a new and unique manner.

SUMMARY OF THE INVENTION

It is an object of the present invention to provide a firearm holding apparatus designed to eliminate user fatigue and strain.

It is another object of the invention to provide a firearm holding apparatus which is easily attached and worn by firearm users.

It is still another object of the invention to provide a firearm holding apparatus which is easily manufactured of inexpensive, readily available materials.

It is still another object of the invention to provide a firearm holding apparatus which is capable of holding firearms of differing size.

It is an even further object of the invention to provide a firearm holding apparatus which will not damage the exterior surface of firearms being transported.

It is an even further object of the invention to provide a firearm holding apparatus which is easily manipulated with one hand or when gloves are worn.

It is an even further object of the invention to provide a firearm holding apparatus of minimal size and compact design.

In accordance with the foregoing objects, the present invention involves a firearm holder of improved efficiency and design. It greatly reduces the fatigue and strain experienced by gun users during extended periods of weapon transport. The invention basically includes first and second gun support means in the form of rigid, plate-like support members which are movable relative to each other. Each gun support member includes a lower end and an upper end. The lower ends of both members are positioned adjacent each other. The upper ends of both members are spaced from each other at a variable distance in order to define a gun receiving zone therebetween. In this orientation, the first and second gun support members form a "V" shape. Positioned within the gun receiving zone and suspended between the first and second gun support members at an angle is a medial support member. In a preferred embodiment, the medial support member is an integral part of a connecting strip having a length sufficient to extend completely around the first and second gun support members while still allowing both members to move relative to each other. Operatively connected to the first and second gun support members is adjustment means in the form of a flexible strap having a length sufficient to completely cover the first gun support member, second gun support member, and medial support member. The strap is preferably manufactured of non-abrasive material in order to prevent frictional abrasion of the gun surface. In addition, the strap includes a free end which is slidably adjustable. This configuration allows adjustment of the strap which permits the distance between the first and second gun support members to be varied. The invention also includes belt attachment means so that the invention may be readily worn by a user. Finally, a spacer unit is preferably secured to the rear of the apparatus so that the lower portion thereof is tilted slightly outward when worn. This feature enables the gun user's weapon to be held in a convenient and readily accessible position.

These and other objects, features, and advantages of the invention shall be described below in the following Brief Description of the Drawings and Detailed Description of a Preferred Embodiment.

DETAILED DESCRIPTION OF A PREFERRED EMBODIMENT

The present invention involves a firearm holding apparatus of improved design which reduces fatigue and strain during weapon transport. The invention is easy to use, comfortable to wear, and is capable of effectively holding firearms of many different sizes. The term "firearm" as used herein may include a wide variety of weapons ranging from shotguns to rifles, and shall not be limited to any specific type of weapon.

A. STRUCTURE

Figure 1:
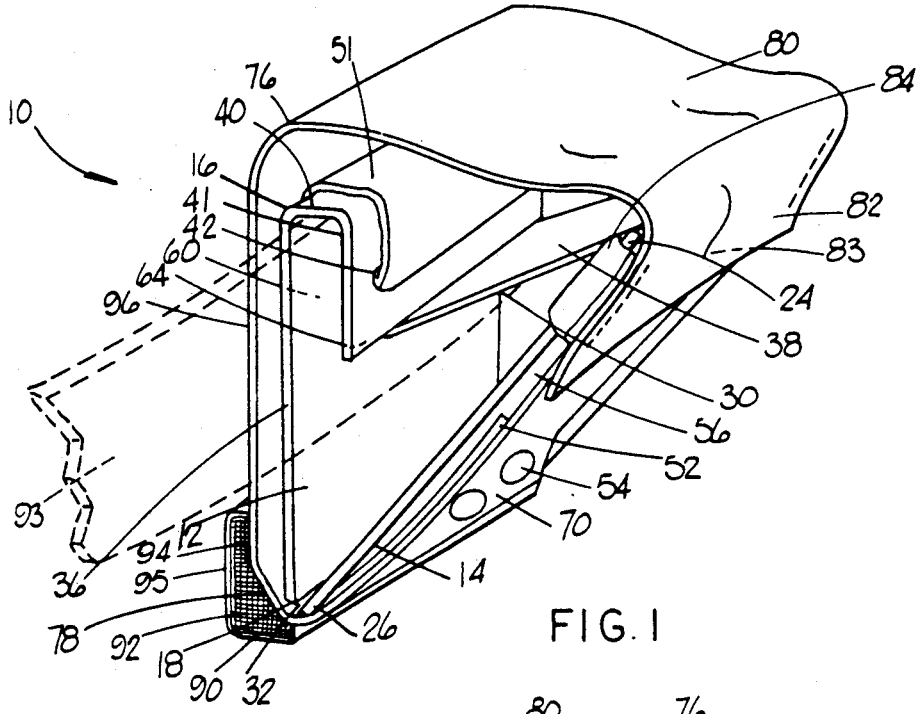
FIG. 1 is a perspective view of the present invention attached to the belt of a user in an open position ready to receive a firearm.
Figure 2:
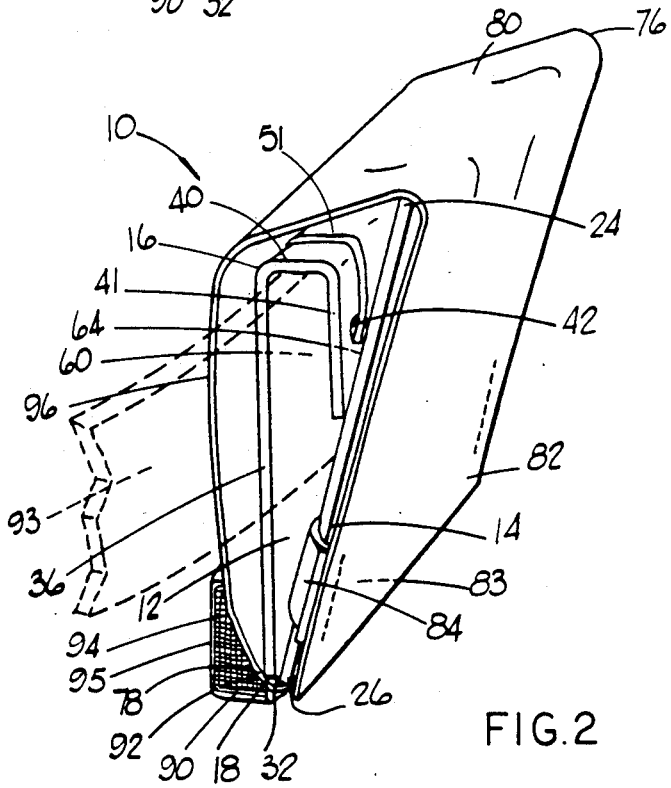
FIG. 2 is a perspective view of the invention of FIG. 1 in a closed position.
Figure 3:
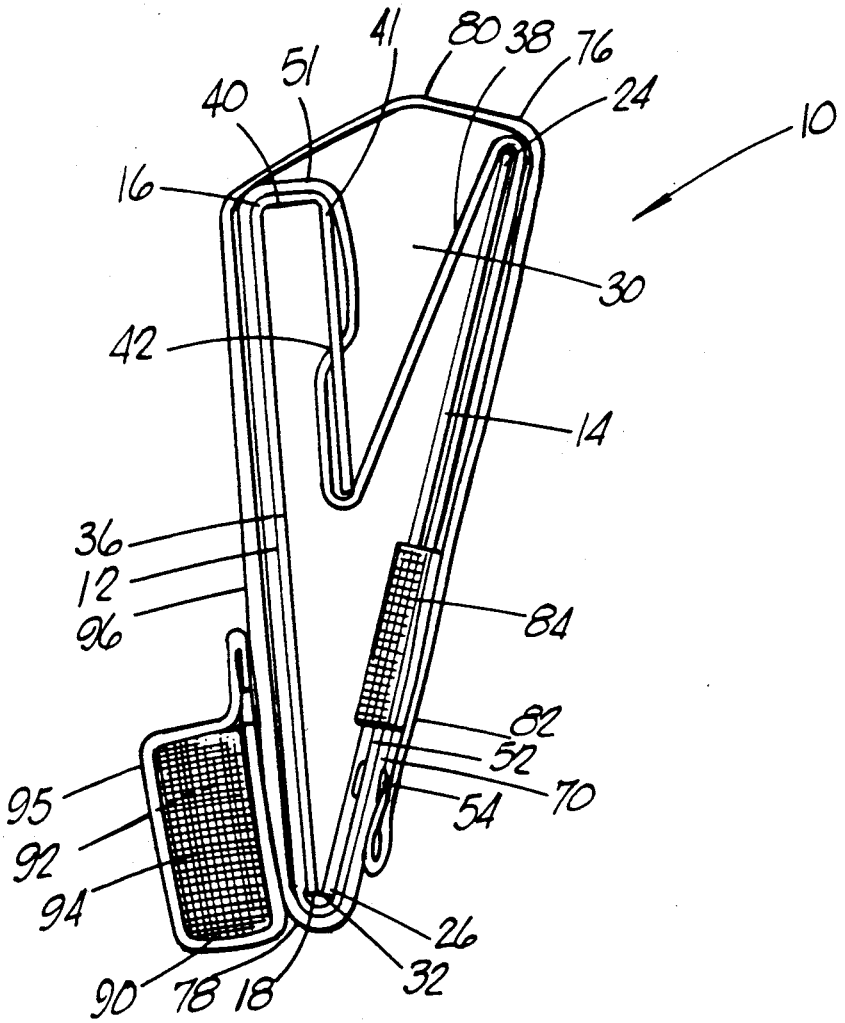
FIG. 3 is a side view of the invention of FIG. 2.

With reference to FIGS. 1-3, a firearm holder 10 produced in accordance with the present invention is illustrated. The holder 10 includes a first gun support member 12 and a second gun support member 14. Both of the support members 12, 14 are constructed of a strong, rigid material (e.g. aluminum, ABS plastic, or the like). The support member 12 includes an upper end 16 and a lower end 18. Likewise, the support member 14 includes an upper end 24 and a lower end 26. The lower ends 18, 26 of the support members 12, 14 are positioned directly adjacent each other as shown in FIGS. 1-3. In contrast, the upper ends 16, 24 of the support members 12, 14 are spaced apart from each other in order to 15 form a gun receiving zone 30 (FIG. 1) therebetween. In this configuration, the support members 12, 14 are oriented in a "V" shape as shown.

The support members 12, 14 are movable relative to each other in order to vary the size of the gun receiving zone 30. The size of the gun receiving zone 30 is varied by changing the relative distance between the upper ends 16, 24 of the support members 12, 14. Movement is accomplished by the pivotal rotation of support members 12, 14 at position 32 where the lower ends 18, 26 of the members 12, 14 meet.

The support member 12 includes a first panel 36 and a medial section 40 positioned at the upper end 16 of the member 12 as illustrated in FIG. 1. In a preferred embodiment, the medial section 40 is perpendicular to and integrally formed with the first panel 36. Integrally formed with the medial section 40 is a second panel 41 which is substantially parallel with and spaced outwardly from the first panel 36. The second panel 41 is preferably shorter than the first panel 36, and is about ⅓ the length of the first panel 36.

The second panel 41 also includes a longitudinal slot 42 therethrough (FIG. 1), the function of which will be described hereinafter.

Figure 6:
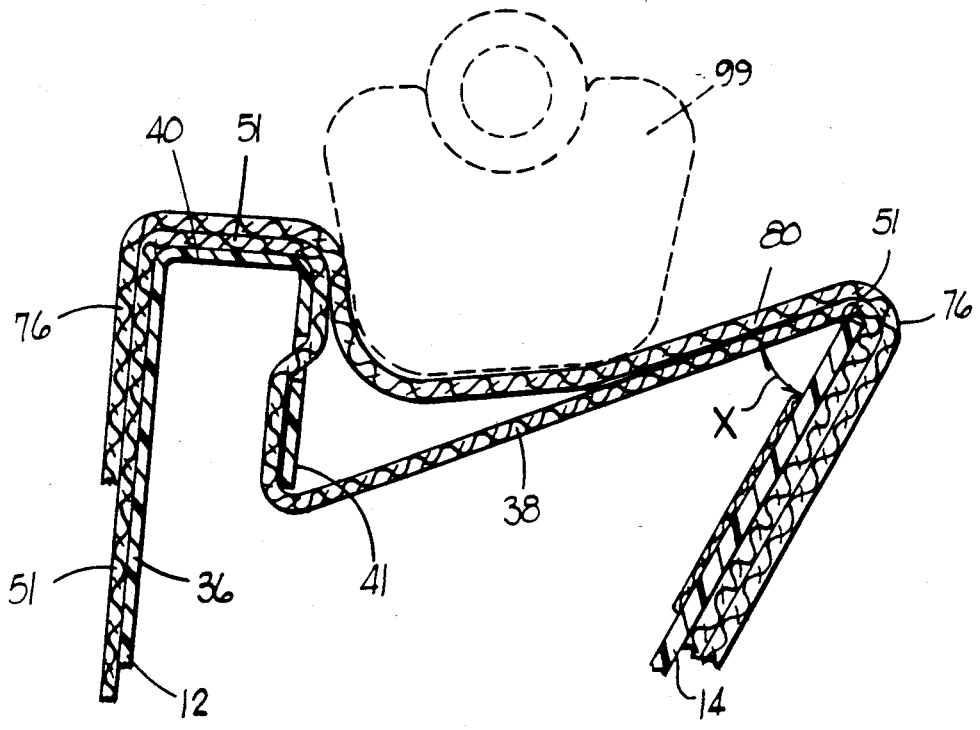
FIG. 6 is an enlarged, partial, cross sectional view of the invention of FIG. 1 having a gun held therein.

Positioned between the support members 12, 14 and suspended from the upper ends 16, 24 thereof is a flexible load-bearing or medial support member 38 (FIG. 1). The medial support member 38 forms an acute angle "X" (less than 90 degrees and preferably about 45 degrees) relative to the support member 38 during use of the holder 10 (FIG. 6). The medial support member 38 is designed to receive the weight of a gun when positioned within the gun receiving zone 30 of the holder 10. In a preferred embodiment, the medial support member 38 is manufactured as an integral part of a flexible connecting strip 51. More specifically, the medial support member 38 and the connecting strip 51 are manufactured as a single unit having a length sufficient to extend around support members 12, 14 while still allowing the members 12, 14 to move relative to each other. Exemplary materials used to construct the connecting strip 51 (and medial support member 38) include ballistic nylon fabric, canvas, or any other strong, water resistant, non-abrasive fabric known in the art.

The connecting strip 51 includes a first end 52 (FIGS. 1-2) secured in position against the outer surface 56 of the second support member 14 using rivets 54 which pass through the support member 14. However, other attachment methods may be used to secure the first end 52 in position, including adhesive affixation, thermal welding, and the like. The connecting strip 51 thereafter extends over the lower ends 18, 26 of the support members 12, 14, and subsequently passes along the outer surface 60 of the first panel 36 of the support member 12. Next, the connecting strip 51 passes over the medial section 40 and the second panel 41, passing through the slot 42. The length of the slot 42 is greater than the width of the connecting strip 51 in order to ensure free, unhindered movement therethrough.

The connecting strip 51 thereafter passes along the underside 64 of the second panel 41 and across the gun receiving zone 30. Within the gun receiving zone 30, the connecting strip 51 consists of the medial support member 38 which is suspended between the support members 12, 14 as described above.

Finally, the connecting strip 51 passes over the upper end 24 of the support member 14 and along the outer surface 56 thereof. The connecting strip 51 terminates in a second end 70 which passes over the first end 52 as illustrated in FIGS. 1 and 3. The second end 70 is positioned adjacent the lower end 26 of the support member 14, and is preferably secured to the support member 14 using the rivets 54 illustrated in FIG. 1.

The holder 10 of the present invention also includes means for adjusting the size of the gun receiving zone 30 (e.g. the distance between the support members 12, 14). Specifically, an adjusting strap 76 is provided which is preferably produced of the same material used to construct the connecting strip 51. The strap 76 includes a first end 78 which begins at position 32 where the lower ends 18, 26 of the support members 12, 14. In a preferred embodiment shown and described herein, the connecting strip 51 and the strap 76 may be manufactured as a single, integral unit which also incorporates the medial support member 38. In this embodiment, the first end 78 of the strap 76 and the second end 70 of the connecting strip 51 are integrally connected at position 32 where the lower ends 18, 26 of the support members 12, 14 meet. In an alternative embodiment, the strap 76 and the connecting strip 51 may be separate units attached together at position 32 by stitching, chemical adhesives, or other conventional fastening methods. For the sake of clarity, the strap 76 and the connecting strip 51 will be described as separate units so that their features may be more accurately characterized.

Figure 4:
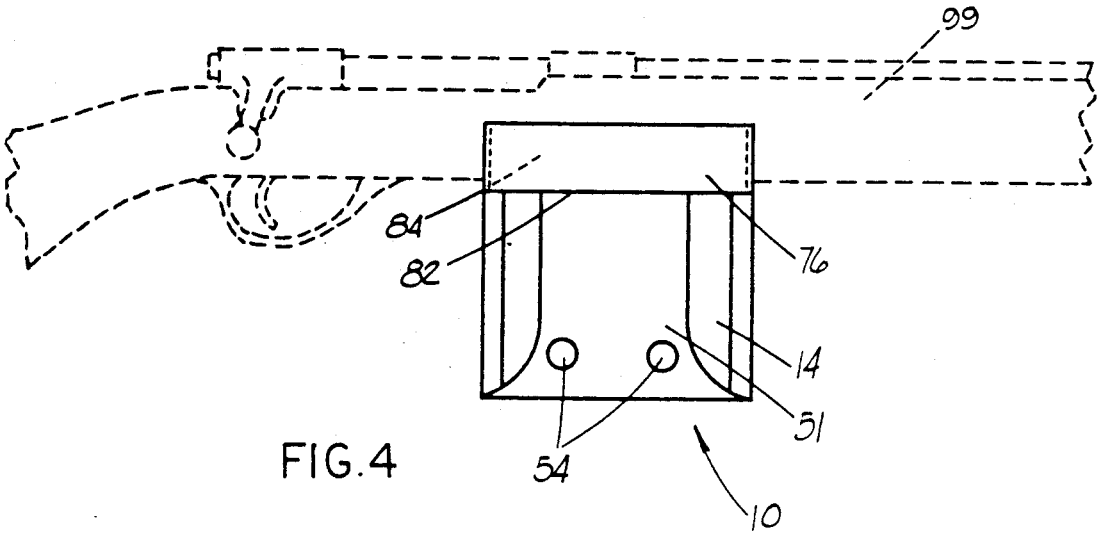
FIG. 4 is a front view of the invention of FIG. 1 holding a gun in a horizontal orientation.
Figure 5:
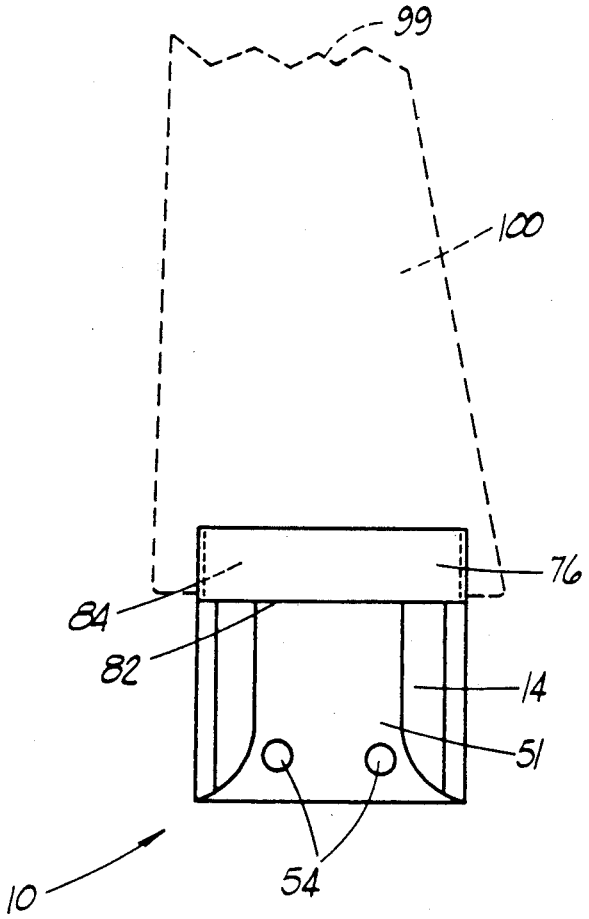
FIG. 5 is a front view of the invention of FIG. 1 holding a gun in a vertical orientation.

As illustrated in FIGS. 4-5, the strap 76 is wider than the support members 12, 14 (by about 1 inch in a preferred embodiment.) The strap 76 extends from position 32 along the outer surface 60 of the first panel 36 of the support member 12, thereby passing over the support members 12, 14 and the connecting strip 51. The portion 80 of the strap 76 which passes over the gun receiving zone 30 is positioned directly over the medial support member 38, and comes in direct contact with the gun during transport in the holder 10. The portion 80 functions as protecting means for the gun since the preferred fabric used to construct the strap 76 (ballistic nylon) is non-abrasive and will not mar or scratch the gun surface.

The second end 82 of the strap 76 is slidably movable along the support member 14. Sliding movement of the second end 82 facilitates the orientation of support members 12, 14 relative to each other in order to vary the size of the gun receiving zone 30. The underside 83 of the second end 82 of the strap 76 includes a loop 84, preferably manufactured of the same material used to construct the strap 76. The loop 84 may be sewn, glued, or attached using conventional mechanical fasteners to the strap 76. The loop 84 has a width slightly greater than that of the support member 14 to facilitate sliding movement thereon. Also, the loop 84 is positioned beneath the medial support member 38 is illustrated is FIG. 1. This configuration prevents inadvertent detachment of the loop 84 from the support member 14.

Finally, the holder 10 includes a spacer 90 secured in position as shown in FIG. 3. In a preferred embodiment, the spacer 90 consists of a plastic (e.g. polyethylene) or wooden bar 92 surrounded by a cloth cover 94. The bar 92 and cover 94 are retained within a sheath 95 (preferably made of the same material used to construct the strap 76). The spacer 90 may then be attached to the outer face 96 of the strap 76 adjacent the first end 78 by sewing the sheath 95 to the strap 76, or by other conventional affixation methods.

The spacer 90 may also be constructed in different ways, and may consist of an extruded plastic portion attached directly by adhesives, staples or the like (not shown) to the strap 76. The spacer 90 causes the bottom portion of the holder 10 to be tilted slightly outward when worn by a user. This enables a firearm to be held in a more comfortable and convenient manner.

B. OPERATION

With reference to FIGS. 1-2, the holder 10 of the present invention is shown in both operating modes. In FIG. 1, the second end 82 of the strap 76 moved upwardly along the support member 14 toward the upper end 24 thereof. This places the holder 10 in an "open" position, with the support member 14 being tilted outward relative to the support member 12. As a result, the gun receiving zone 30 is enlarged prior to receiving a gun. Likewise, the medial support member 38 beneath the strap 76 is extended as shown in FIG. 1 to provide support for the gun. With reference to FIG. 6, extension of the medial support member 38 places the member 38 in an upwardly-angled orientation as illustrated. This occurs because of the structure of the support member 12. Specifically, the medial support member 38 first passes over the second panel 41 of the support member 12, followed by passage of the member 38 through the slot 42. The medial support member 38 thereafter extends upwardly toward and over the support member 14, forming an acute (less than 90 degree) angle "X" relative to support member 14. In a preferred embodiment, the angle "X" is about 45 degrees as indicated above. The angled orientation of the support member 38 facilitates retention of the user's gun within the gun receiving zone 30 of the holder 10. With reference to FIG. 1, the user's belt 93 is threaded between the first panel 36 and the second panel 41 of the support member 12 as illustrated.

In FIG. 2, the holder 10 is shown in a "closed" position, with the support member 14 being positioned inwardly against the second panel 41 of the support member 12. This substantially closes the gun receiving zone 30, and retracts the medial support member 38 from its previous position. To place the holder 10 is a "closed" configuration, the second end 82 of the strap 76 is slidably positioned adjacent the lower end 26 of the support member 14 (FIG. 2), resulting in a neat and compact appearance. When the holder 10 is in the configuration of FIG. 2, a user can crawl through brush, on the ground, etc, without the holder 10 hindering the user's movement. In addition, the structure of the holder 10 as described herein allows it to be easily opened and closed using one hand, or when gloves are worn.

FIGS. 4-6 illustrate the holder 10 having a rifle 99 positioned therein. In FIGS. 4 and 6, the rifle 99 is maintained in a horizontal orientation. In FIG. 5, the rifle 99 is held in a vertical position, with the rifle butt 100 resting in the gun receiving zone 30 of the invention. In either orientation, the rifle 99 is transported in a convenient and comfortable manner, thereby eliminating user fatigue and strain.

Having herein described a preferred embodiment of the invention, it is anticipated that suitable modifications may be made thereto by individuals skilled in the art within the scope of the invention. Thus, the scope of the invention shall only be construed in accordance with the following claims:

I claim:

1. A gun holding apparatus for attachment to a belt worn by a gun user comprising:

a first gun support member;

a second gun support member positioned adjacent said first gun support member, said first gun support member and said second gun support member being movable relative to each other in order to provide an open, gun receiving zone therebetween;

load bearing means positioned within said gun receiving zone for bearing the weight of a gun positioned in said gun receiving zone, said load bearing means being operatively connected to and between said first gun support member and said second gun support member;

said loan bearing means comprises a medial support member suspended between said first gun support member and said second gun support member;

an elongate strip of material having a length sufficient to wrap over and around said first gun support member and said second gun support member in order to enclose said first and second gun support members therein while allowing said first and second gun support members to move relative to each other, at least one part of said strip of material comprising said medial support member;

and means for attaching said holding apparatus to a user's belt such that said load bearing means extends in a generally horizontal direction.

2. The apparatus of claim 1 further comprising adjustment means for varying the distance between said first gun support member and said second gun support member in order to control the size of said gun receiving zone.

3. The apparatus of claim 2 wherein said adjustment means comprises a strap member having a length sufficient to extend over and around said first gun support member and said second gun support member.

4. The apparatus of claim 3 wherein said strap member is comprised of flexible fabric.

5. The apparatus of claim 3 wherein said strap member comprises at least one end which is slidably movable along said second gun support member.

6. The apparatus of claim 3 wherein said strap member further comprises orientation means secured thereto for enabling said apparatus to be properly positioned on said belt of said user.

7. The apparatus of claim 6 wherein said orientation means comprises at least one outwardly extending spacer member attached to said strap member.

8. The apparatus of claim 1 wherein said first gun support member comprises an upper end and a lower end, and said second gun support member comprises an upper end and a lower end, said lower end of said first gun support member being positioned against said lower end of said second gun support member, with said upper end of said first gun support member being spaced apart from said upper end of second gun support member in order to form said gun receiving zone therebetween.

9. The apparatus of claim 1 further comprising means for positioning said medial support member between said first gun support member and said second gun support member so that said medial support member forms an acute angle relative to said second gun support member during the use of said apparatus.

10. The apparatus of claim 4 wherein said medial support member is comprised of flexible fabric.

11. The apparatus of claim 1 wherein said strip of material is fixedly secured to said second gun support member.

12. The apparatus of claim 1 wherein said strip of material is comprised of flexible fabric.

13. The apparatus of claim 1 wherein said first gun support member comprises a first planar section and a second planar section attached to and parallel with said first planar section, said second planar section being shorter in length than said first planar section.

14. The apparatus of claim 10 wherein said second planar section comprises a opening therethrough, said strip of material being threaded through said opening and thereafter extending outwardly toward and over said second gun support member.

15. The apparatus of claim 1 further comprising protection means within said gun receiving zone for protecting the exterior surface of a gun during transport in said apparatus.

16. The apparatus of claim 15 wherein said protection means comprises at least one portion of flexible, non-abrasive fabric.

17. A gun holding apparatus for attachment to a belt worn by a gun user comprising:

a first gun support member;

a second gun support member positioned adjacent said first gun support member, said first gun support member and said second gun support member being movable relative to each other in order to provide an open, gun receiving zone therebetween, said first gun support member comprising an upper end and a lower end, and said second gun support member comprising an upper end and a lower end, said lower end of said first gun support member being positioned against said lower end of said second gun support member, with said upper end of said first gun support member being spaced apart from said upper end of second gun support member in order to form said gun receiving zone therebetween;

load bearing means positioned within said gun receiving zone for bearing the weight of a gun positioned in said gun receiving zone, said load bearing means comprising a medial support member suspended between said upper end of said first gun support member and said upper end of said second gun support member, said medial support member being flexible so as to enable said first gun support member and said second gun support member to move relative to each other with said medial support member therebetween;

adjustment means for varying the distance between said first gun support member and said second gun support member in order to control the size of said gun receiving zone;

said adjustment means comprises a strap member having a length sufficient to extend over and around said first gun support member and said second gun support member;

and means for attaching said holding apparatus to a user's belt such that said load bearing means extends in a generally horizontal direction.

18. The apparatus of claim 17 further comprising an elongate strip of material having a length sufficient to wrap over and around said first gun support member and said second gun support member in order to enclose said first and second gun support members therein while allowing said first and second gun support members to move relative to each other, at least one part of said strip of material comprising said medial support member.

19. A gun holding apparatus for attachment to a belt worn by a gun user comprising:

a first gun support member;

a second gun support member positioned adjacent said first gun support member, said first gun support member and said second gun support member being movable relative to each other in order to provide an open, gun receiving zone therebetween;

an elongate strip of material having a length sufficient to wrap over and around said first gun support member and said second gun support member in order to enclose said first and second gun support members therein while allowing said first and second gun support members to move relative to each other, at least one part of said strip of material comprising a medial support member suspended between said first gun support member and said second gun support member within said gun receiving zone, and at least one part of said strip of material comprising a strap member for adjusting the distance between said first gun support member and said second gun support member;

and means for attaching said holding apparatus to a user's belt such that said load bearing means extends in a generally horizontal direction.

20. A gun holding apparatus for attachment to a belt worn by a gun user comprising:

a first gun support member comprising an upper end, a lower end, a first planar section and a second planar section, said first planar section being parallel to said second planar section and attached thereto at said upper end of said first gun support member, said second planar section being shorter in length than said first planar section and comprising an opening therethrough;

a second gun support member comprising an upper end and a lower end, said lower end of said second gun support member being positioned against said lower end of said first gun support member, with said upper end of said first gun support member being spaced apart from said upper end of second gun support member in order to form a gun receiving zone therebetween;

a flexible medial support member suspended between said first gun support member and said second gun support member, said medial support member forming an acute angle relative to said second gun support member during the use of said apparatus;

an elongate strip of flexible material having a length sufficient to wrap over said first gun support member and pass through said opening in said second planar section of said first gun support member, said strip of flexible material thereafter passing over and around said second gun support member in order to enclose said first and second gun support members therein while allowing said first and second gun support members to move relative to each other, at least one part of said strip comprising said medial support member, and at least one part of said strip being fixedly secured to said second gun support member;

a flexible strap member having a length sufficient to pass over and around said first gun support member, said second gun support member, and said medial support member, said strap member comprising at least one end which is slidably movable along said second gun support member;

at least one outwardly extending spacer member secured to said strap member for facilitating the proper orientation of said apparatus on said belt of said user;

and means for attaching said holding apparatus to a user's belt such that said load bearing means extends in a generally horizontal direction.

* * * * *